US009227114B2

(12) United States Patent
Takechi

(10) Patent No.: US 9,227,114 B2
(45) Date of Patent: Jan. 5, 2016

(54) IRON TYPE GOLF CLUB HEAD

(71) Applicant: BRIDGESTONE SPORTS CO., LTD., Tokyo (JP)

(72) Inventor: Takaharu Takechi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/246,318

(22) Filed: Apr. 7, 2014

(65) Prior Publication Data

US 2014/0335973 A1 Nov. 13, 2014

(30) Foreign Application Priority Data

May 10, 2013 (JP) ..... 2013-100318

(51) Int. Cl.
*A63B 53/04* (2015.01)

(52) U.S. Cl.
CPC ..... *A63B 53/047* (2013.01); *A63B 53/0475* (2013.01); *A63B 2053/0433* (2013.01)

(58) Field of Classification Search
CPC ..... A63B 53/047; A63B 53/0475; A63B 2053/0433; A63B 2053/0454
USPC ..... 473/350, 344, 346, 338
See application file for complete search history.

(56) References Cited

U.S. PATENT DOCUMENTS

| | | | | |
|---|---|---|---|---|
| 5,472,203 | A | 12/1995 | Schmidt et al. | |
| 5,749,795 | A | 5/1998 | Schmidt et al. | |
| 7,980,960 | B2 | 7/2011 | Gilbert et al. | |
| 8,911,301 | B1 * | 12/2014 | Allen | 473/329 |
| 2012/0196703 | A1 | 8/2012 | Sander | |
| 2012/0202615 | A1 | 8/2012 | Beach et al. | |
| 2012/0289361 | A1 | 11/2012 | Beach et al. | |
| 2013/0331201 | A1 * | 12/2013 | Wahl et al. | 473/329 |

FOREIGN PATENT DOCUMENTS

| | | |
|---|---|---|
| JP | 8-10359 A | 1/1996 |
| JP | 3115147 U | 11/2005 |

* cited by examiner

*Primary Examiner* — Benjamin Layno
(74) *Attorney, Agent, or Firm* — Sughrue Mion, PLLC

(57) ABSTRACT

An iron type golf club head includes: a main body portion having a face surface and a sole surface; a backward bulging section provided at a lower back section of the main body portion, the bulging section including: an upper surface side recess formed to extend downward from the upper surface of the backward bulging section; and a lower surface side recess formed to extend upward from the lower surface of the backward bulging section; and a hosel portion connected to the main body portion, wherein the upper surface side recess and the lower surface side recess are overlapped at least in part with each other in the perspective side view of the head when viewed from the toe side of the iron type golf club head.

10 Claims, 12 Drawing Sheets

IRON TYPE GOLF CLUB HEAD

CROSS-REFERENCE TO RELATED APPLICATION(S)

This application is based upon and claims the benefit of priority from Japanese Patent Application No. 2013-100318, filed on May 10, 2013, the entire contents of which are incorporated herein by reference.

BACKGROUND

1. Field of the Invention

The invention relates to an iron type golf club head and, specifically, to an iron type golf club head, the sole portion of which includes a backward bulging section having recesses respectively formed in the upper and lower surfaces thereof.

2. Description of the Related Art

An iron type golf club includes: an iron club mainly used for shots from the fairway, rough, bunker etc., and for tee shots in a short hole (a par-three hole); and, a utility club containing a head having a similar shape to the iron head.

As the head of the iron club, there is widely used a head in which its face portion to its hosel portion are made of stainless steel, carbon steel, various alloys or the like.

The iron club head includes a face surface for hitting a ball and a sole surface facing the ground. The head has a hosel portion on the heel side thereof. A shaft is inserted into the hosel portion and is fixed thereto by fixing means such as adhesive.

In the case of an iron type golf club head including a bulging section of a shape formed by bulging backward the sole side portion thereof, its center of gravity is low and the distance (gravity depth) of the center of gravity from the face surface is large. The iron type golf club head including such bulging section tends to be liked by a powerless player.

JP-A-H08-10359 discloses an iron type golf club head in which recesses are formed in both of the upper and lower surfaces of such sole bulging section to thereby adjust the balance and weight of the head.

US-A1-2012-0196703 discloses an iron head which includes grooves (channels) formed along the front edge portion of the sole thereof. According to US-A1-2012-0196703, formation of such grooves can enhance the repulsion characteristics of the head when hitting a ball.

Besides, U.S. Pat. No. 5,749,795B2, U.S. Pat. No. 7,980,960B2, U.S. Pat. No. 5,472,203B2, US-A1-2012-0289361, As the patent document involved with a golf club head, US-A1-2012-0202615 and JP-UM-U-3115147 are also related to the iron type golf club head.

In JP-A-H08-10359, since the lower surface side recess of the sole bulging section is disposed below the upper surface side recess thereof, the upper surface side and lower surface side recesses are both small in depth, whereby the degree of freedom for adjusting the weight and balance of the head is small.

SUMMARY

An object of the invention is to provide an iron type golf club head which can increase the depths of the upper surface side and lower surface side recesses of the sole bulging section to thereby increase the degree of freedom for adjusting the weight and balance of the head.

An iron type golf club head according to the invention includes: a main body portion including a face surface and a sole surface, the lower back section of the main body portion providing a backward bulging section, the bulging section including an upper surface side recess formed to extend downward from the upper surface thereof and a lower surface side recess formed to extend upward from the lower surface thereof; and, a hosel portion connected to the main body portion, wherein the upper surface side and lower surface side recesses are overlapped at least in part with each other in the perspective side view of the head when viewed from the toe side thereof.

According to a first embodiment of the invention, the upper surface side recess includes a toe-side upper surface side recess and a heel-side upper surface side recess, and the lower surface side recess is interposed between the toe-side and heel-side upper surface side recesses. In this case, the longitudinal direction width of the lower surface side recess may be smaller than that of the upper surface side recess.

According to a second embodiment of the invention, the upper surface side recess includes a toe side recess, a heel side recess and a center recess connecting the toe side and heel side recesses to each other, and the lower surface side recess is disposed behind the center recess.

According to a third embodiment of the invention, the upper surface side recess extends from the toe side of the bulging section to the heel side thereof and the lower surface side recess is situated behind the upper surface side recess.

According to the iron type golf club head of the invention, since the upper surface side and lower surface side recesses respectively formed in the bulging section are overlapped at least in part with each other in the perspective side view of the head when viewed from the toe side, the upper surface recess can enhance the degree of freedom for adjusting the weight and balance of the head. Also, in spite of formation of the upper surface side recess, the lower surface side recess can be arranged on the face surface side regardless of the position of the upper surface side recess. This can enhance the degree of freedom for adjusting the weight and balance of the iron type golf club head.

BRIEF DESCRIPTION OF THE DRAWINGS

The present invention will become more fully understood from the detailed description given hereinbelow and the accompanying drawing which is given byway of illustration only, and thus is not limitative of the present invention and wherein.

DETAILED DESCRIPTION OF THE INVENTION

Now, description is given of the first embodiment with reference to FIGS. 1 to 7.

This iron type golf club head 1 includes a main body portion 2 and a hosel portion 3 connected to the main body portion 2. The hosel portion 3 includes a hosel hole (not shown) for insertion of a shaft. The front of the main body portion 2 is a face surface 2*f* which includes a large number of score lines (grooves, not shown). The lower section of the main body portion 2 provides a bulging section (which is called hereinafter a sole bulge) 4 having a backward bulging shape.

Of the peripheral edge section of the back of the main body portion 2, the toe side, top side and heel side cooperate together to provide a back fringe section 2*a* constituted of a protruded strip. An area surrounded by the back fringe section 2*a* provides a back surface 2*b*.

The sole bulge 4 extends from the toe side of the golf club head 1 to the heel side. The base of the sole bulge 4 is a sole surface 4*s*. In this embodiment, the back of the sole bulge 4 provides an inclined surface 4*a* connected to the rear edge of the sole surface 4*s* and inclined upward toward the face surface 2*f*. The toe side and heel side of the inclined surface 4*a* are connected to the back fringe section 2*a*. The upper-most surface of the sole bulge 4 existing near to the toe/heel direction central portion thereof provides an upper surface 4*b* substantially perpendicular to the back surface 2*b*.

Figure 12:
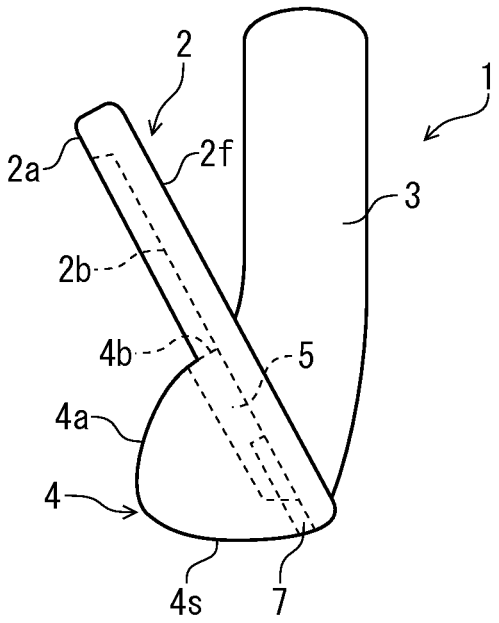
FIG. 12 is a perspective side view of an iron type golf club head when viewed from the toe side thereof.

In this embodiment, the upper surface 4*b* includes upper surface side recesses 5 and 6 respectively formed on its toe and heel sides. Also, the sole surface 4*s* includes a lower surface side recess 7. The lower surface side recess 7 is interposed between the upper surface side recesses 5, 6. The upper surface side recesses 5, 6 and lower surface side recess 7, as shown in FIG. 12, are formed to be overlapped at least in part with each other in a perspective side view when viewed from the toe side. Here, the perspective side view when viewed from the toe side is a left side view (that is, a side view of the toe side) when a state where the face surface 2*f* is viewed from front is a front view, and also a side view when the respective recesses 5~7 are seen through.

The upper surface side recesses 5, 6 extend substantially parallel to the face surface 2*a* toward the sole surface 4*s*. The toe/heel direction lengths $W_5$, $W_6$ (FIG. 1) of the upper side recesses 5, 6 may preferably be about 5~40 mm, especially preferably, about 10~20 mm. The widths (longitudinal widths) $T_5$ (FIG. 4), $T_6$ (FIG. 6) of the upper surface side recesses 5, 6 in the direction perpendicular to the face surface 2*a* may preferably be about 1~10 mm, especially preferably, about 2~5 mm. The face-side inner surfaces 5*f*, 6*f* of the upper surface side recesses 5, 6 are parallel to the face surface 2*f*. The distances $D_5$, $D_6$ of the inner surfaces 5*f*, 6*f* from the face surface 2*a* may preferably be about 1~5 mm, especially preferably, about 2~4 mm.

The heights $H_5$, $H_6$ (FIGS. 4, 6) of the deepest portions 5*e*, 6*e* of the upper surface side recesses 5, 6 from the sole surface 4*s* may preferably be about 1~10 mm, especially preferably, about 2~5 mm. The distance L (FIG. 1) between the upper surface side recesses 5, 6 may preferably be about 2~40 mm, especially preferably, about 20~30 mm.

Figure 1:
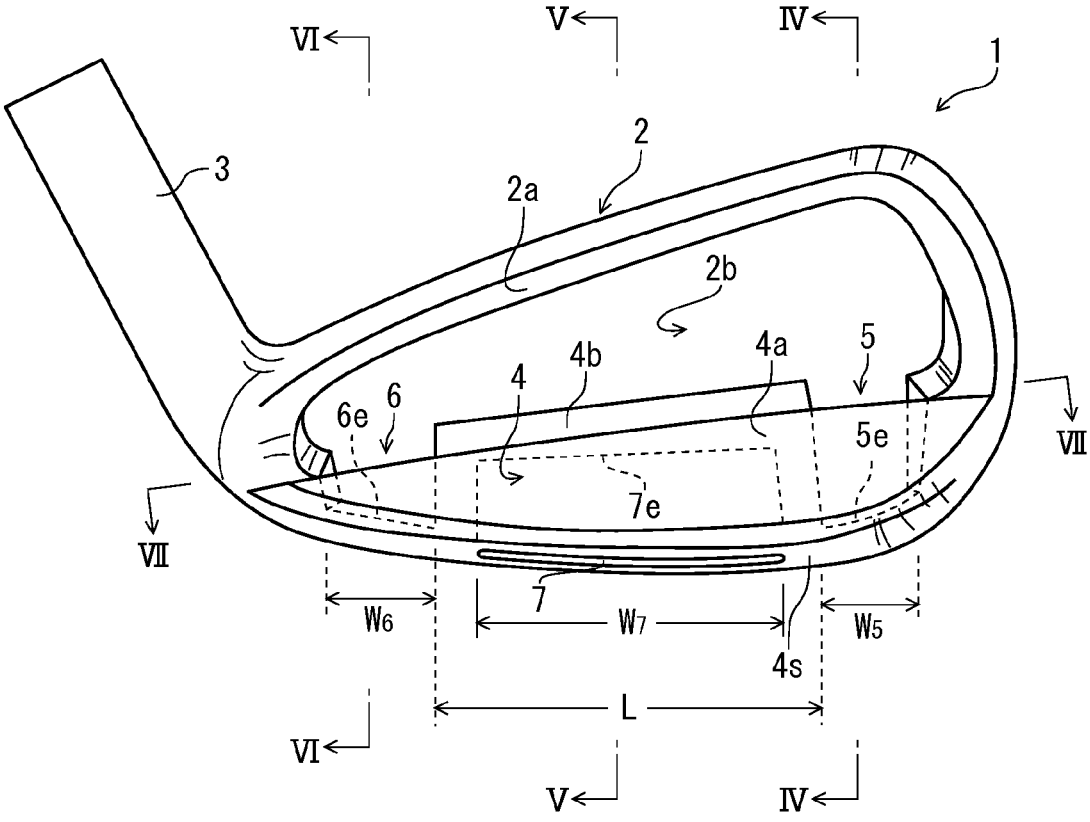
FIG. 1 is a back view of an iron type golf club head according to a first embodiment.
Figure 2:
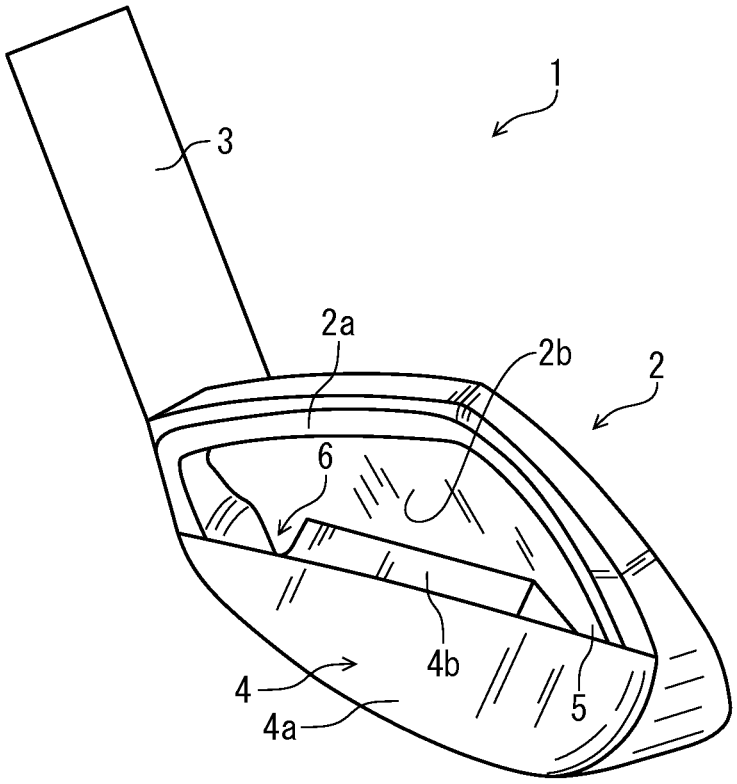
FIG. 2 is a perspective view of the iron type golf club head of the first embodiment.
Figure 3:
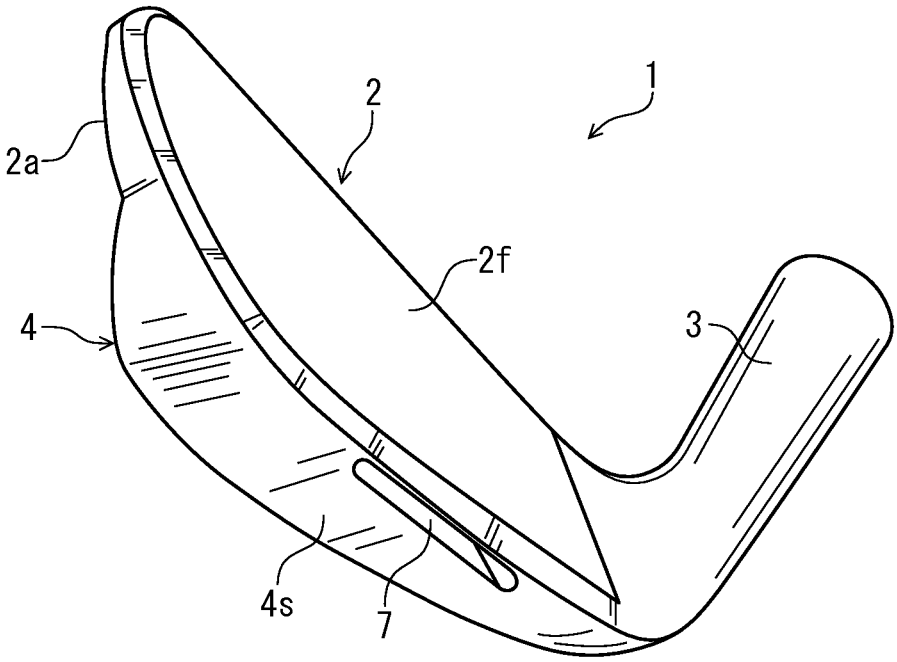
FIG. 3 is a perspective view of the iron type golf club head of the first embodiment, when viewed from below.
Figure 4:
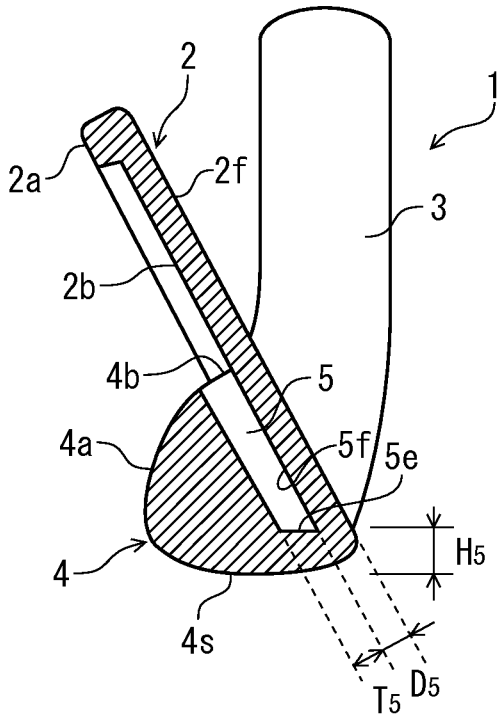
FIG. 4 is a section view taken along the line IV-IV shown in FIG. 1.
Figure 6:
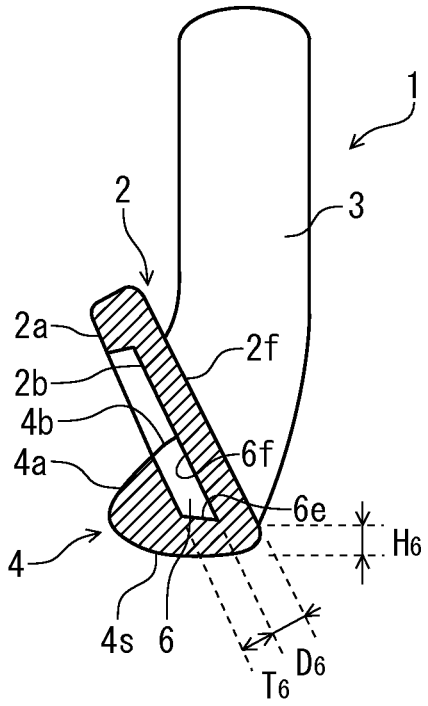
FIG. 6 is a section view taken along the line VI-VI shown in FIG. 1.
Figure 7:
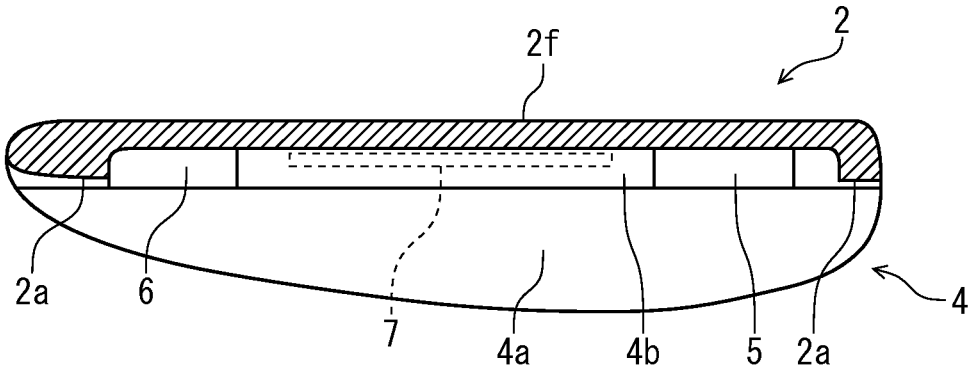
FIG. 7 is a section view taken along the line VII-VII shown in FIG. 1.

Here, in this embodiment, as shown in FIGS. 4, 6, the face-surface side inner surfaces 5*f*, 6*f* of the upper surface side recesses 5, 6 are flush with the back surface 2*b*. However, this is not limitative.

Figure 5:
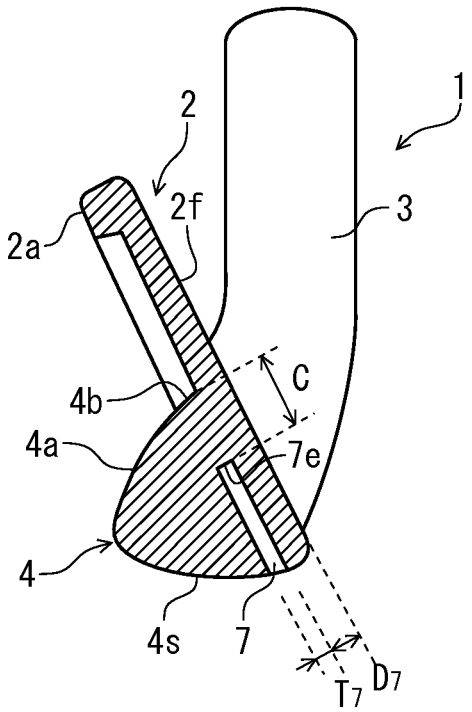
FIG. 5 is a section view taken along the line V-V shown in FIG. 1.

The lower surface side recess 7 has a deep slit shape extending in the toe/heel direction and extends from just near the upper surface side recess 5 to just near the upper surface side recess 6 in the toe/heel direction. The toe/heel direction length $W_7$ of the lower surface side recess 7 may preferably be about 10~40 mm, especially preferably, about 20~30 mm. As shown in FIG. 5, the width $T_7$ of the lower surface side recess 7 in the direction perpendicular to the face surface 2*f* may preferably be about 1~10 mm, especially preferably, about 2~4 mm. This width $T_7$ may preferably be 10~100% of the widths $T_5$, $T_6$ of the upper surface side recesses 5, 6, especially preferably, 30~60%.

The distance C between the ceiling portion 7*e* of the lower surface side recess 7 and sole bulge upper surface 4*b* may preferably be about 2~30 mm, especially preferably, about 10~20 mm. The distance $D_7$ of the lower surface side recess 7 from the face surface 2*f* may preferably be about 1~20 mm, especially preferably, 1~10 mm, more preferably, about 1~5 mm.

The deepest portions 5*e*, 6*e* of the upper surface side recesses 5, 6 may preferably be situated by 0.1~20 mm, especially preferably, by 4~10 mm lower than the ceiling portion 7*e* of the lower surface side recess 7.

In the thus structured iron type golf club head 1, the upper surface side recesses 5, 6 are shifted from the lower surface side recess 7 in the toe/heel direction. And, since, in the perspective side view (FIG. 12) of the head 1 when viewed from the toe side, the upper surface side recesses 5, 6 are overlapped with the lower surface side recess 7 at least in part, in spite of formation of the upper surface side recesses 5, 6, the lower surface side recess 7 can be disposed on the face surface side regardless of the positions of the upper surface side recesses 5, 6. This can provide a high degree of freedom for adjusting the weight and balance of the head 1 and also can enhance the repulsion characteristics thereof.

In this embodiment, the lower surface side recess 7 having a deep slit shape extending in the toe/heel direction is formed near to the face surface 2*f*, and the upper surface side recesses 5, 6 respectively having a deep recessed hole shape are formed on the toe and heel sides respectively. Thus, while the repulsion characteristics of the head when hitting a ball by the center of the face surface can be enhanced, the structure of the upper surface side recess can enhance the function of the head.

Figure 9:
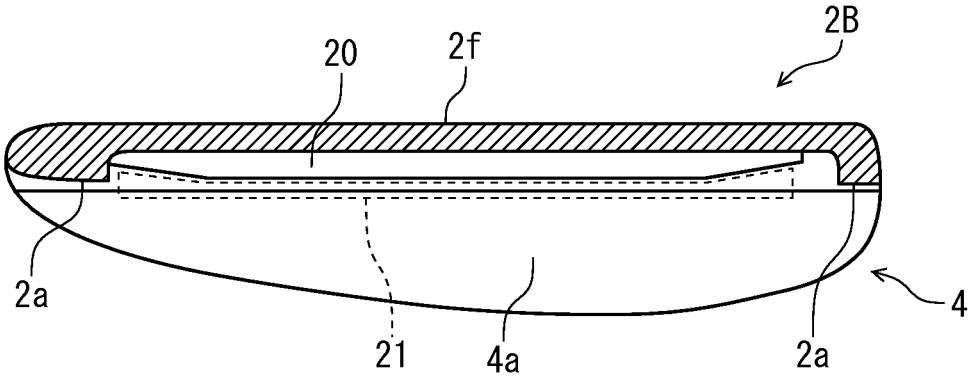
FIG. 9 is a section view of an iron type golf club head according to a third embodiment.
Figure 10:
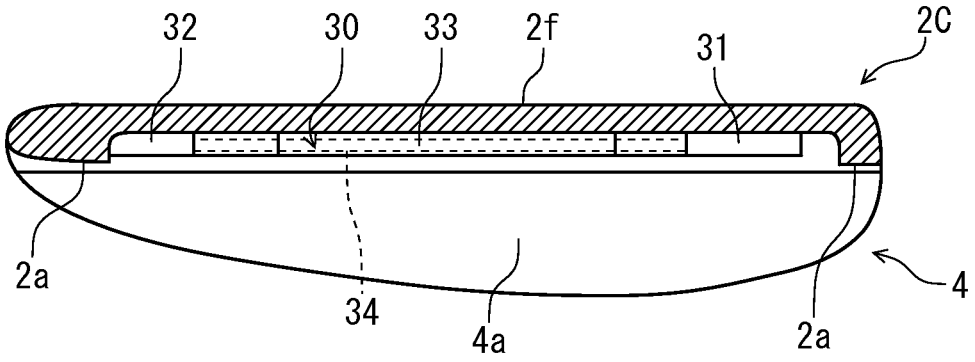
FIG. 10 is a section view of an iron type golf club head according to a fourth embodiment.
Figure 11:
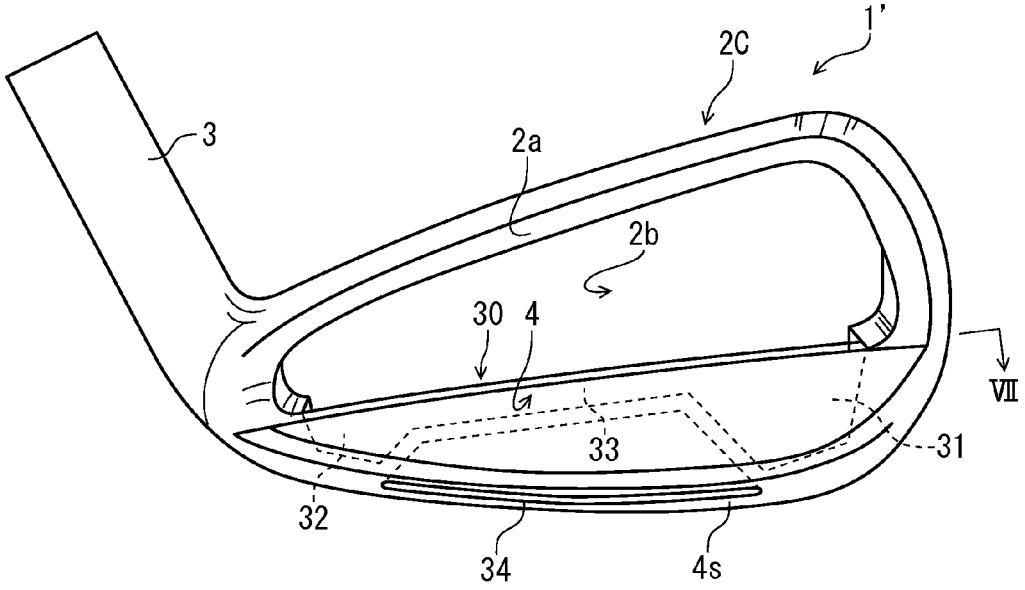
FIG. 11 is a back view of the iron type golf club head shown in FIG. 10.

Now, description is given of the main body portions 2A, 2B and 2C of iron type golf club heads according to second to fourth embodiments with reference to FIGS. 8~11. Here, FIGS. 8~10 respectively show the same portion as in FIG. 7. FIG. 11 is a back view of a head 1' having the main body portion 2C shown in FIG. 10.

Figure 8:
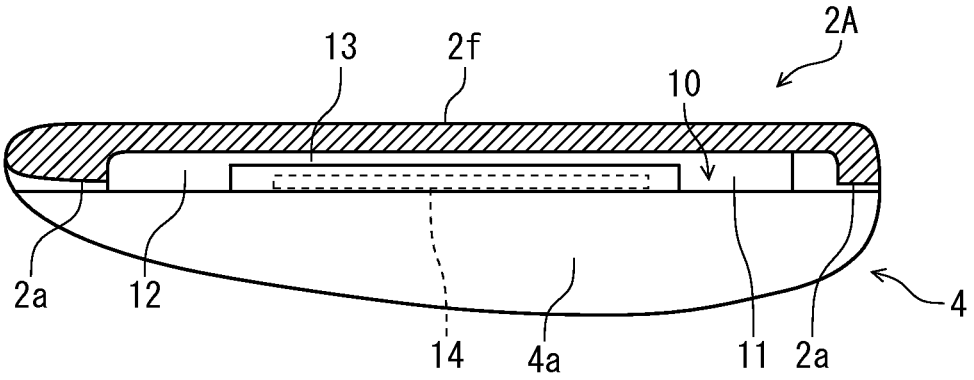
FIG. 8 is a section view of an iron type golf club head according to a second embodiment.

In the head main body portion 2A shown in FIG. 8, an upper surface side recess 10 includes a toe side recess 11, a heel side recess 12 and a center recess 13 connected to the recesses 11, 12. The face surface 2*f* side inner surfaces of the recesses 11~13 are flush with each other. The toe side recess 11 and heel side recess 12 are larger than the center recess 13 in the width (longitudinal width) in the direction perpendicular to the face surface 2*f*.

Between the recesses 11 and 12, there is formed a lower surface side recess 14. This lower surface side recess 14 has a deep slit-like shape substantially parallel to the center recess 13. The upper surface side recess 10 and lower surface side recess 14 are at least in part overlapped with each other in the perspective side view of the head when viewed from the toe side. The ceiling portion of the lower surface side recess 14 is situated higher than the deepest portion of the upper surface side recess 10. The lower surface side recess 14 is situated behind the center recess 13. The longitudinal width of the lower surface side recess 14 is smaller than that of the recesses 11, 12. The head having such main body portion 2A also can provide a high degree of freedom for adjusting the weight and balance thereof. Here, according to the head of FIG. 8, while the upper surface side recess is formed larger, the lower surface side recess can be disposed in the center of the face surface. Due to this, while providing the enhanced repulsion characteristics of the head when hitting a ball by the center of the face surface, the structure of the upper surface side recess can enhance the head function.

In the head main body portion 2B shown in FIG. 9, an upper surface recess 20 and a lower surface recess 21 extend continuously from the toe neighboring portion to the heel neighboring portion. The upper surface side recess 20 and lower surface side recess 21 are at least in part overlapped with each other in the perspective side view of the head when viewed from the toe side. The ceiling portion of the lower surface side recess 21 is situated higher than the deepest portion of the upper surface side recess 20. The lower surface side recess 21 is situated behind the upper surface side recess 20. Here, the toe and heel sides of the lower surface side recess 21 are slightly larger than the center portion in the width (longitudinal width) in the direction perpendicular to the face surface 2*f*. In reverse, the toe and heel sides of the upper surface side recess 20 are slightly smaller than the center portion in the width (longitudinal width) in the direction perpendicular to the face surface 2*f*. The upper surface side recess 20 and lower surface side recess 21 are at least in part overlapped with each other in the perspective side view of the head when viewed from the toe side.

The head having such main body portion 2B also can provide a high degree of freedom for adjusting the weight and balance of the head. According to this embodiment, while the upper surface side recess is formed larger, the lower surface side recess can be disposed to extend from the toe side to the heel side. Thus, the repulsion characteristics can be enhanced in the wide range of the face surface and the structure of the upper surface side recess can enhance the head function.

In a head 1' having a main body portion 2C shown in FIGS. 10 and 11, an upper surface side recess 30 includes a toe side recess 31, a heel side recess 32 and a center recess 33 connected to the recesses 31, 32. The face surface 2*f* side inner surfaces of the recesses 31~33 are flush with each other and are substantially parallel to the face surface 2*f*. The longitudinal width of the upper surface recess 30 is even from the toe side to the heel side.

The toe side recess 31 and heel side recess 32 are deeper than the center recess 33. The depth decreases gradually from the toe side recess 31 and heel side recess 32 toward the center recess 33.

A lower surface side recess 34 extends substantially parallel to the face surface 2*f* in the toe/heel direction. In the back view (FIG. 11) of the head 1', the lower surface side recess 34 is interposed between the toe side recess 31 and heel side recess 32. The side edge of the lower surface side recess 34 extends along the side edges of the toe side recess 31 and heel side recess 32. The ceiling portion of the lower surface side recess 34 extends along the base of the center recess 33 in the toe/heel direction. The ceiling portion of the lower surface side recess 34 is situated higher than the bases of the toe side recess 31 and heel side recess 32 but is situated lower than the center recess 33. That is, the ceiling portion of the lower surface side recess 34 is situated higher than the deepest portion of the upper surface side recess 30. The upper surface side recess 30 and lower surface side recess 34 are overlapped at least in part with each other in the perspective side view of the head when viewed from the toe side.

The remaining structures of the head 1' are similar to those of the head 1 and thus the same designations show the same parts.

This head 1' also can provide a high degree of freedom for adjusting the weight and balance of the head. Here, according to the head 1' of FIGS. 10, 11, while the upper surface side recess is formed larger, the lower surface side recess can be disposed in the center of the face surface. Thus, while enhancing the repulsion characteristics when hitting a ball by the center of the face surface, the structure of the upper surface side recess can attain the enhanced head function.

The above embodiments are just an example of the invention and the invention can also be enforced in other embodiments than those shown herein. For example, the recesses may also have different shapes and depths from those illustrated herein.

Although the iron type golf club heads 1, 1' shown herein are substantially the same as a conventional iron head in appearance, the invention can also be applied to an iron type utility head similar in outer shape to the iron head.

What is claimed is:

1. An iron type golf club head comprising:

a main body portion having a face surface and a sole surface;

a backward bulging section provided at a lower back section of the main body portion, the bulging section including:

an upper surface side recess formed to extend downward from the upper surface of the backward bulging section; and a lower surface side recess formed to extend upward from the lower surface of the backward bulging section; and a hosel portion connected to the main body portion, wherein the upper surface side recess and the lower surface side recess are overlapped at least in part with each other in the perspective side view of the head when viewed from the toe side of the iron type golf club head.

2. The iron type golf club head according to claim 1, wherein:

the upper surface side recess includes a toe-side upper surface side recess and a heel-side upper surface side recess; and the lower surface side recess is interposed between the toe-side and heel-side upper surface side recesses.

3. The iron type golf club head according to claim 2, wherein the longitudinal direction width of the lower surface side recess is smaller than the longitudinal direction width of the upper surface side recess.

4. The iron type golf club head according to claim 2, wherein the toe-side upper surface side recess is separated from the heel-side upper surface side recess.

5. The iron type golf club head according to claim 1, wherein:

the upper surface side recess includes a toe side recess;

a heel side recess and a center recess connecting the toe side and heel side recesses to each other; and the lower surface side recess is disposed behind the center recess.

6. The iron type golf club head according to claim 1, wherein:

the upper surface side recess extends from the toe side of the bulging section to the heel side thereof; and the lower surface side recess is situated behind the upper surface side recess.

7. The iron type golf club head according to claim 1, wherein the ceiling portion of the lower surface side recess is situated higher than the deepest portion of the upper surface side recess.

8. The iron type golf club head according to claim 1, wherein a part of the lower surface side recess is located at an area between a back surface of the upper surface side recess and the face surface in the perspective side view of the head when viewed from the toe side of the iron type golf club head.

9. The iron type golf club head according to claim 1, wherein:

the upper surface side recess includes a toe-side upper surface side recess, a heel-side upper surface side recess and a center recess; and an uppermost part of the lower surface side recess is located at a position higher than a lowermost part of the toe-side upper surface side recess and a lowermost part of the heel-side upper surface side recess and lower than the center recess.

10. The iron type golf club head according to claim 9, wherein the center recess connects the toe-side upper surface side recess with the heel-side upper surface side recess.

* * * * *